US006158074A

United States Patent [19]

Castille

[11] Patent Number: 6,158,074

[45] Date of Patent: Dec. 12, 2000

[54] PIPE CLEANING MACHINE

[76] Inventor: Alan J. Castille, 513 Robert Lee Cir., Lafayette, La. 70506

[21] Appl. No.: 09/268,407

[22] Filed: Mar. 15, 1999

[51] Int. Cl.[7] ..... B08B 9/023; B08B 9/027

[52] U.S. Cl. ..... 15/88; 15/104.04; 15/104.05

[58] Field of Search ..... 15/104.03, 104.04, 15/104.05, 88

[56] References Cited

U.S. PATENT DOCUMENTS

| | | | |
|---|---|---|---|
| 1,012,049 | 12/1911 | Armstrong | 15/88 |
| 2,152,036 | 3/1939 | Froh | 15/88 |
| 2,267,435 | 12/1941 | Thomas | 15/88 X |
| 2,838,778 | 6/1958 | Von Arx | 15/104.03 |
| 3,210,788 | 10/1965 | Holliday | 15/88 |
| 4,156,949 | 6/1979 | Ziegelmeyer | 15/88 |
| 4,166,301 | 9/1979 | Smith | 15/88 |
| 4,271,556 | 6/1981 | Farrell, Jr. | 15/104.31 |
| 4,306,914 | 12/1981 | Long | 15/104.04 X |
| 4,600,444 | 7/1986 | Miner | 134/8 |
| 5,535,473 | 7/1996 | Maniar | 15/104.33 |
| 5,647,906 | 7/1997 | Monday et al. | 118/70 |
| 5,940,920 | 8/1999 | Hare et al. | 15/88 |

FOREIGN PATENT DOCUMENTS

| | | | |
|---|---|---|---|
| 392991 | 12/1973 | Russian Federation | 15/104.04 |

*Primary Examiner*—Mark Spisich
*Attorney, Agent, or Firm*—David L. Ray

[57] ABSTRACT

An apparatus for cleaning the interior and exterior of a corroded pipe including a pipe shuttle for rotatable holding a pipe being cleaned, a stationary lance assembly for insertion into the interior of the pipe to scrape and clean the interior of the pipe, an external scraper for scraping the outer surface of the pipe, a wire brush assembly for cleaning the outer surface of the pipe, and a drive car for rotating the pipe and driving the rotating pipe onto the lance assembly and into contact with the external scraper and the wire brush assembly.

17 Claims, 14 Drawing Sheets

PIPE CLEANING MACHINE

BACKGROUND OF THE INVENTION

1. Field of the Invention

The present invention relates to an apparatus for cleaning the interior and exterior of pipes. In particularly, the present invention relates to an apparatus for cleaning the interior and exterior of pipe used in the petroleum and natural gas exploration industry.

2. Description of the Related Art

It is known in the art that steel pipe will rust and corrode. In particular, steel pipe used in the oil and gas exploration industry encounter rust and corrosion due to exposure to the elements and to various chemicals flowing through and around the pipe. Such pipe is commonly quite expensive, and therefore there is a need for removal of rust and corrosion both outside and inside the pipe to enable further use of the pipe.

Certain industries such as the oil and gas production and exploration industry require that pipe used in drilling and production operations has a certain minimum inside diameter, or "drift", to enable standard sized tools to be dropped into the pipe and travel completely therethrough. Therefore when cleaning oil and gas production pipe for re-use in production and exploration operations, it is necessary to insure that a certain minimum inside diameter is maintained throughout the length of the pipe.

Various apparatus are relevant to the art of cleaning the interior and/or exterior of pipe. Exemplary of such apparatus are those disclosed in the following U.S. Pat. Nos.: 5,647,906; 5,535,473; 4,600,444; 4,271,556; 4,166,301; 4,156,949; 3,210,788 and 1,012,049.

SUMMARY OF THE INVENTION

In accordance with the present invention there is provided an apparatus for cleaning the interior and exterior of a pipe, the apparatus including a pipe shuttle for rotatable holding a pipe being cleaned, a stationary lance assembly for insertion into the interior of the pipe to scrape and clean the interior of the pipe, an external scraper for scraping the outer surface of the pipe, a wire brush assembly for cleaning the outer surface of the pipe, and a drive car for rotating the pipe and driving the rotating pipe onto the lance assembly and into contact with the external scraper and the wire brush assembly.

The apparatus has the advantage of being operated by a single operator, or the apparatus may be programmed to run automatically. The apparatus utilizes water to flush corrosion particles and rust removed from the pipe into a tank, thus preventing dangerous clouds of rust and corrosion particles from being created in the vicinity of the apparatus, and preventing contaminated water from being released into the environment.

DESCRIPTION OF THE PREFERRED EMBODIMENTS

Figure 1A:
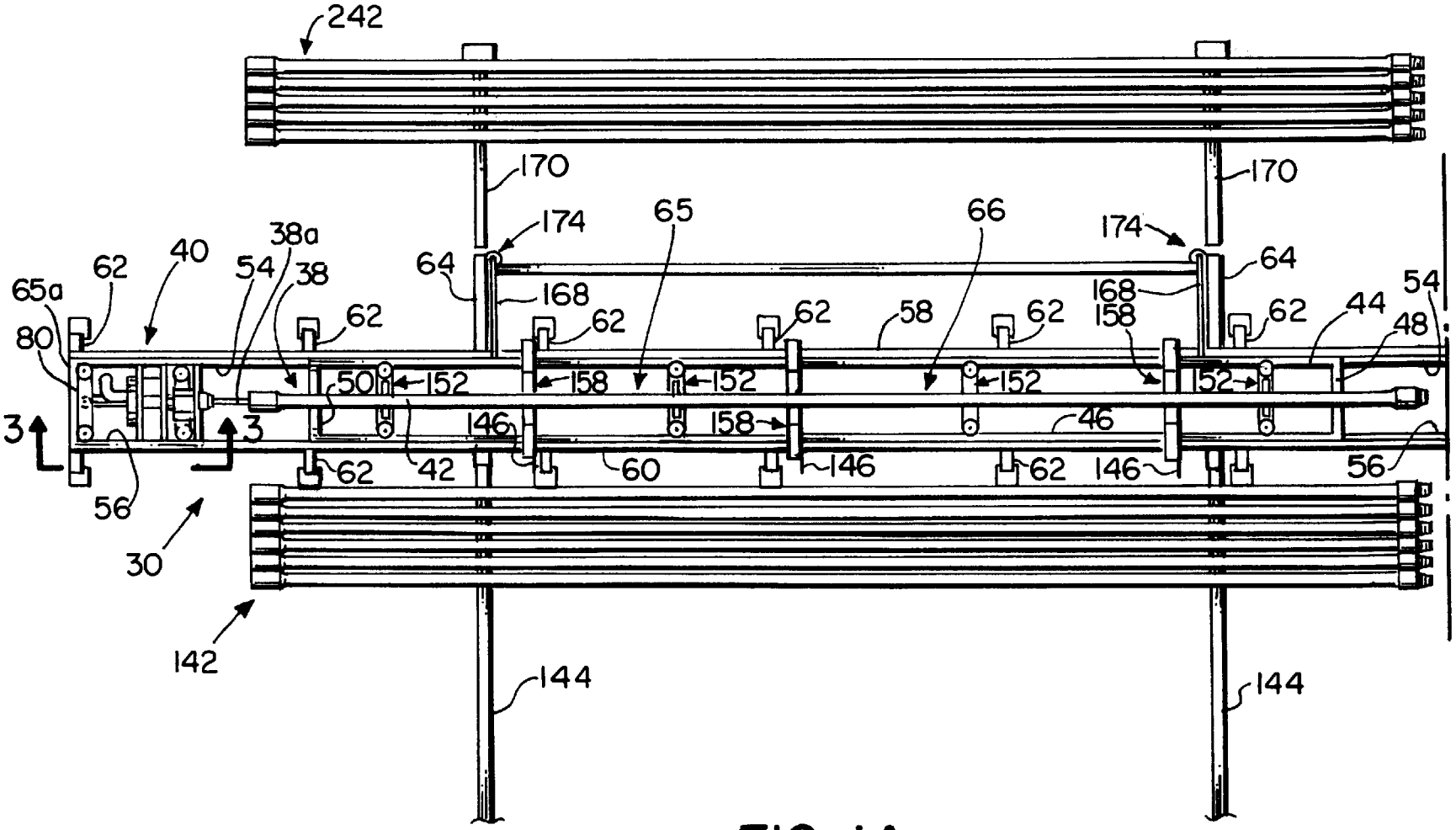
FIGS. 1A, 1B combined show a schematic top view, partially cut-away, of the pipe cleaning machine of the invention.
Figure 1B:
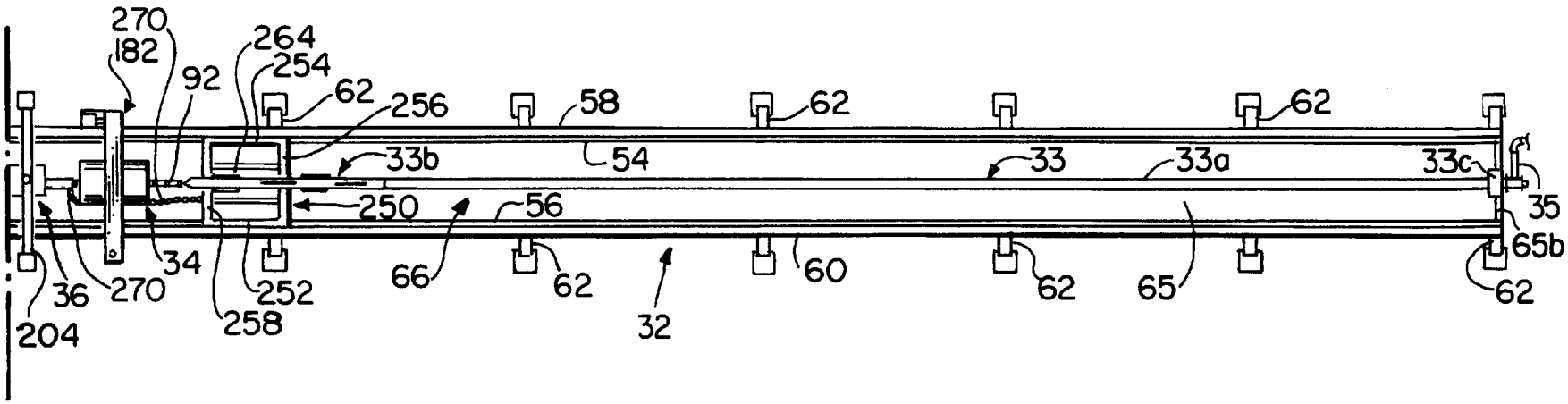

Referring now to the drawings, and in particular to FIGS. 1A and 1B, the pipe cleaning machine of the invention includes a pipe feeding assembly generally indicated by the numeral 30 in FIG. 1A and a lance assembly generally indicated by the numeral 32 in FIG. 1B. Lance assembly 32 includes a lance generally indicated by the numeral 33, and lance 33 includes a support pipe 33*a* and an internal scraper 33*b* rigidly connected thereto. Support pipe 33*a* is held at one end by bracket 33*c* which rigidly connects pipe 33*a* to end plate 65*b* to prevent pipe 33*a* and internal scraper 33*b* from rotating.

Figure 2A:
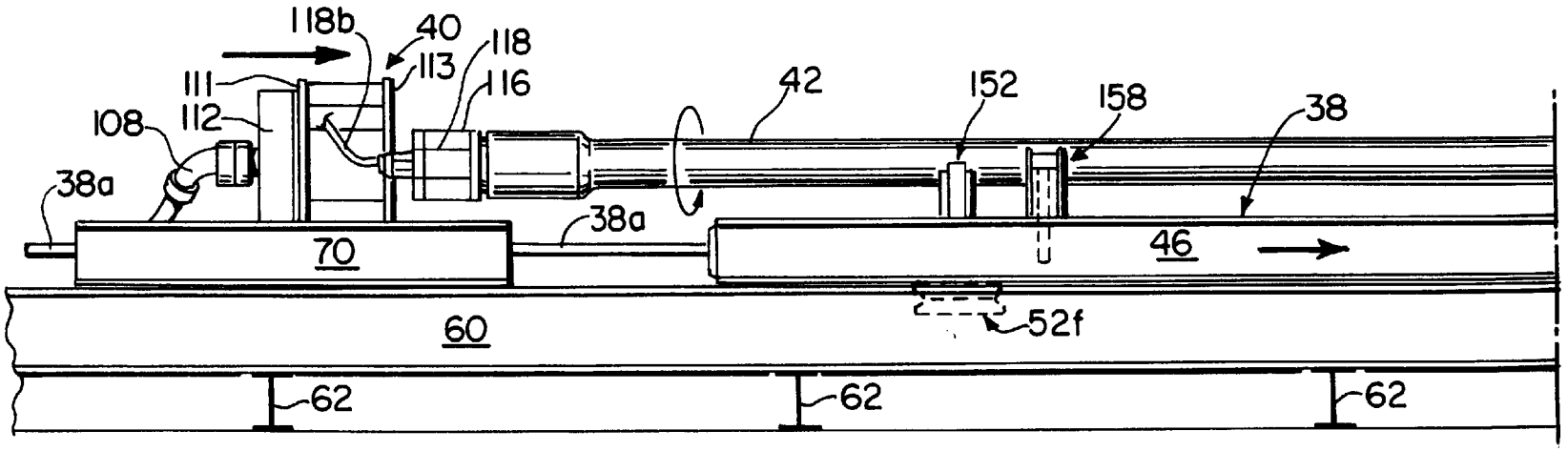
FIGS. 2A, 2B combined show a schematic side view, partially cut-away, of the pipe cleaning machine shown in FIGS. 1A and 1B.
Figure 2B:
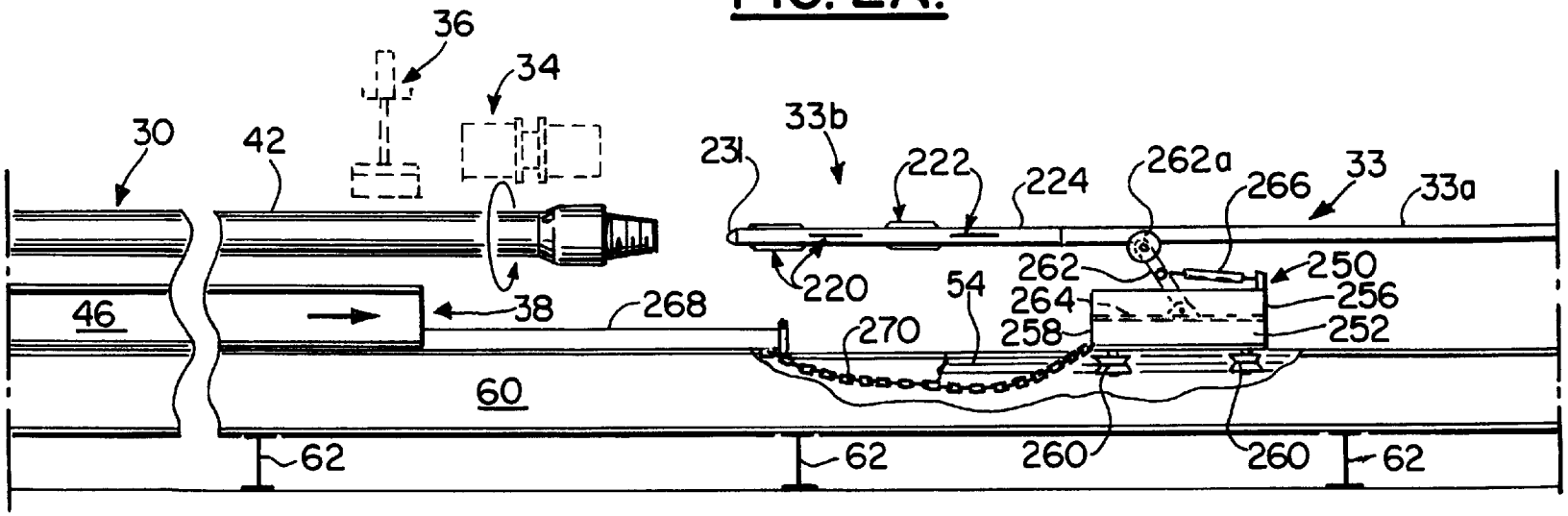
Figure 19:
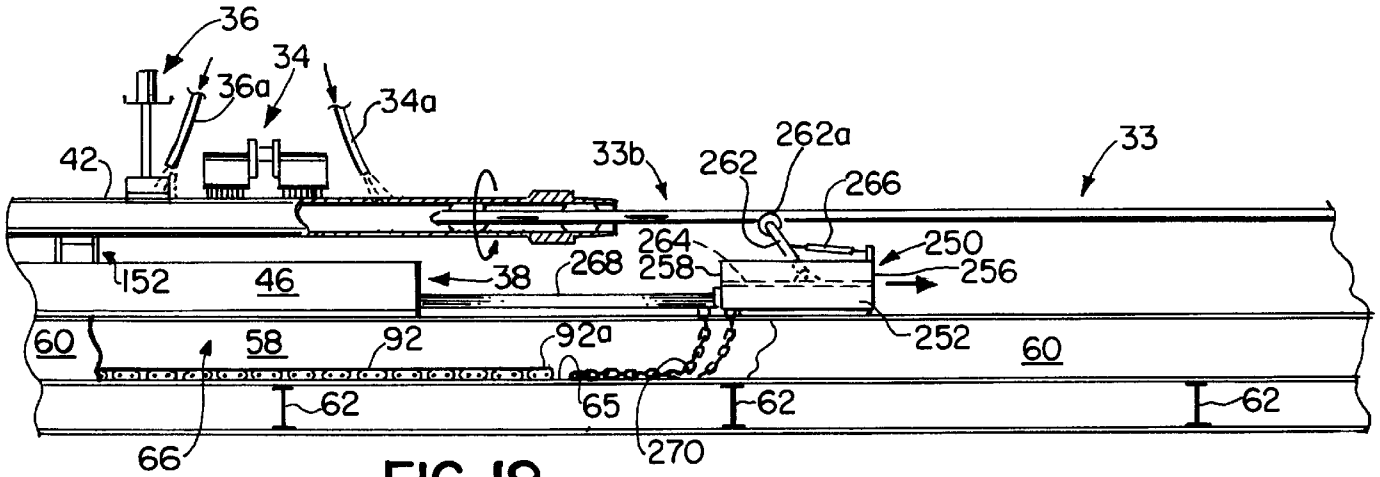
FIG. 19 is a schematic, partly cut-away, partly cross-sectional elevational view of the pipe cleaning machine shown in FIGS. 1A and 1B with the internal scraper assembly inserted inside of a pipe.

The pipe feeding assembly 30 can move a pipe 42 to be cleaned toward and onto the lance assembly 32, and away from lance assembly 32 after cleaning. Water under pressure is supplied to support pipe 33*a* of lance 33 from water supply 35 as shown in FIG. 1B. As shown in FIGS. 2B and 19, lance 33 is aligned to enter the interior of pipe 42 to scrape rust and corrosion from the inside of pipe 42 while pipe 42 is rotating in the direction shown by the arrows in FIGS. 2A and 2B. Preferably, internal scraper 33*b* is connected to support pipe 33*a* by threads 33*d* shown in FIG. 21. Water under pressure flows outward from internal scraper 33*b* of lance 33 into the interior of pipe 42 as shown by the arrows in FIG. 23.

While pipe 42 is rotating, the exterior of pipe 42 is cleaned by a conventional rotating wire brush assembly generally indicated by the numeral 34 in FIGS. 1B, 2B, 10, 11, and 12. The exterior of pipe 42 is also cleaned by the novel external scraper assembly generally indicated by the numeral 36 in FIGS. 1B, 2B, and 12–19 to remove scale and rust from the exterior of pipe 42 which is not or cannot be removed by wire brush assembly 34.

As can be seen in FIG. 19, water from water hose 34*a* is directed onto the area of the surface of pipe 42 being contacted by brush assembly 34, and water from hose 36*a* is directed on the area of the external surface of pipe 42 being contacted by external scraper 36. Water hose 34*a* connected to brush assembly 34 by bracket 34*b*, and water hose 36*a* is connected to external scraper 36 by bracket 36*b*. Water removes particles of corrosion and rust removed from the exterior and interior of pipe 42. If water is not provided to remove particles of corrosion and dust removed from pipe 42, the particles of rust and corrosion can become airborne and create a hazardous cloud of particles which could harm personnel and contaminate the area contacted by the cloud. Furthermore, water provided during pipe cleaning lubricates the surface of pipe 42 being contacted by brush assembly 34 and external scraper 36 and the interior of the pipe being contacted by lance 33 to reduce friction and noise generated during rust and corrosion removal.

Pipe feeding assembly 30 includes a pipe shuttle generally indicated by the numeral 38 in FIG. 1A for receiving and holding a pipe 42 to be cleaned, and a drive car generally indicated by the numeral 40 in FIGS. 1A, 2A, and 3–6. Drive car 40 drives pipe shuttle 38 to and from lance assembly 32 and rotates pipe 42 while pipe 42 is supported on pipe shuttle 38.

Figure 5:
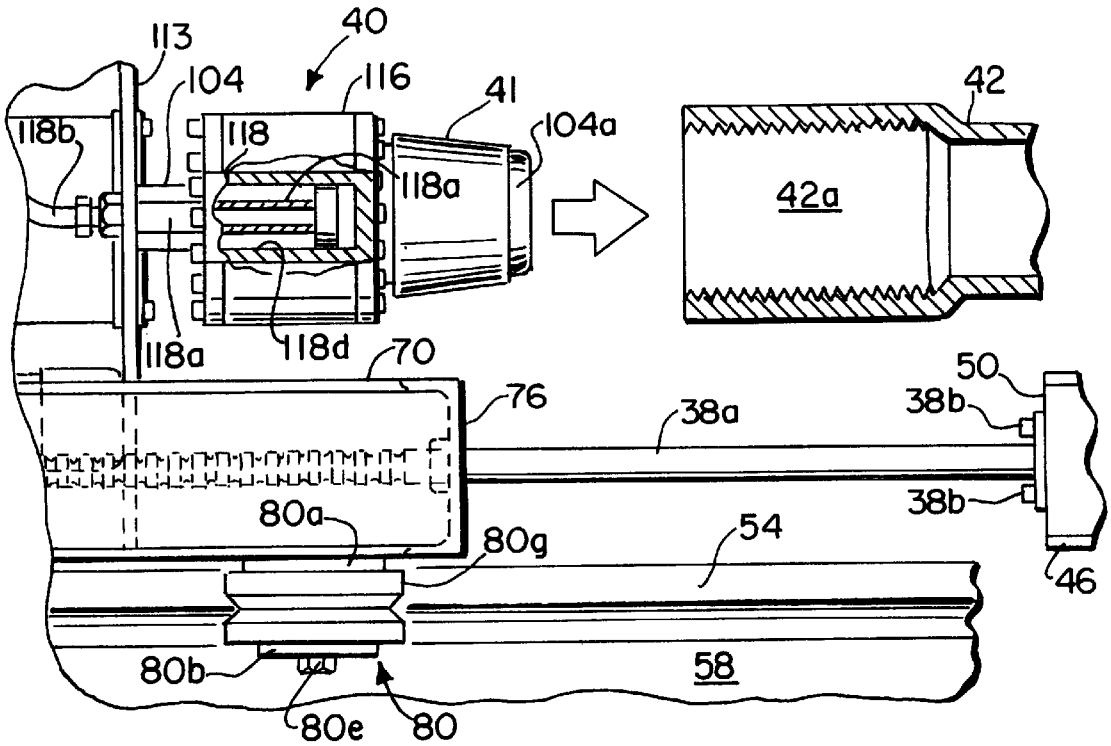
FIG. 5 is a schematic side view, partially cut-away, partly cross-sectional, of the drive car and mandrel of the invention aligned for insertion in the internally threaded end of a pipe.
Figure 5A:
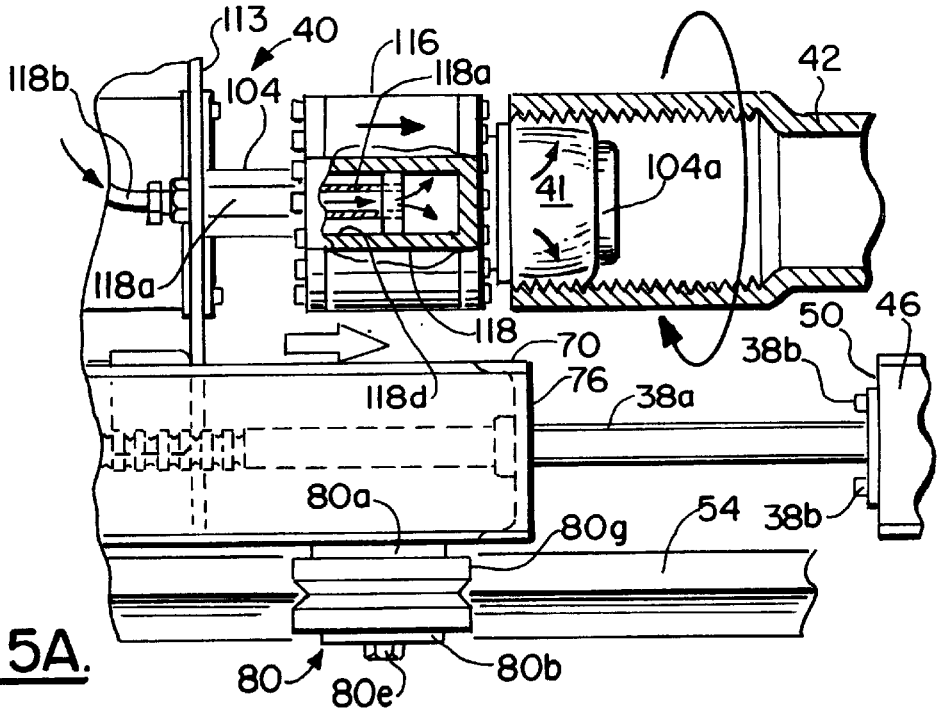
FIG. 5A is a side view of the mandrel of the invention after insertion into the internally threaded end of a pipe.

Drive car 40 is selectively connected to and disconnected from pipe shuttle 38 by connecting rod 38*a* shown in FIGS. 1A, 2A, 3, 5, 5A, 6, 6A, and 6B. Drive car 40 is selectively connected to and disconnected from pipe 42 by rotating elastic mandrel generally indicated by the numeral 41 as shown in FIGS. 5 and 5A. Connecting rod 38*a* is rigidly connected to pipe shuttle 38 by bolts 38*b* shown in FIGS. 5 and 5A. Rusty and corroded pipe, such as pipe 42, is carried to and from external scraper 36, wire brush assembly 34, and lance assembly 32 by pipe shuffle 38 when connected to drive car 40 by connecting rod 38*a*.

Pipe shuttle 38 includes two parallel elongated side beams 44 and 46 which are rigidly connected together by flat metal plates 48 and 50 shown in FIG. 1A. As is known in the art, rigid connections between the various elements of the invention may be accomplished by welding, bolting, screwing, or the like. Beams 44 and 46 are also rigidly connected together by a plurality of roller assemblies generally indicated by the numeral 52.

As can be seen in FIGS. 7–11, roller assemblies 52 include a top plate 52*a* and a bottom plate 52*b* rigidly connected together by a spacer plate 53*c*. Also connected to 52*a* and 52*b* are pins 52*d* and 52*e* which hold rollers 52*f* and 52*g* thereon, respectively. Rollers 52*f* and 52*g* make rolling contact with tracks 54 and 56 to enable pipe shuttle 38 to move along tracks 54 and 56 to feed pipe 42 onto lance assembly 32.

Tracks 54 and 56 are rigidly connected to beams 58 and 60, respectively, as shown in FIGS. 1–12. Beams 58 and 60 are supported by a plurality of support beams 62—62 shown in FIGS. 1A, 1B, 2A, 2B, 10, 11 and 13 and by two beams 64—64 shown in FIGS. 1B, and 7–9.

As can be seen in FIGS. 1A, 1B, and 7–11, a generally rectangular flat plate 65 is rigidly connected to the top of support beams 62—62 and beams 64—64. Flat plate 65 is rigidly connected at its two parallel longer edges to the bottom inside surface of beams 58 and 60. The two shorter parallel edges of flat plate 65 are rigidly connected to vertical end plates 65*a* and 65*b* shown in FIGS. 1A and 1B. A water-tight tank generally indicated by the numeral 66 in FIGS. 1A, 1B is therefore formed with the bottom of tank 66 being flat plate 65, the side walls of tank 66 being beams 58 and 60, and end walls of tank 66 being end plates 65*a* and 65*b*. Tank 66 catches and holds water which flows from hoses 34*a* and 36*a* onto the surface of pipe 42, and water which flows out of internal scraper 33*b* into pipe 42, together with the particulate corrosion removed from pipe 42. The fluids contained in tank 66 may be pumped to a suitable reservoir as desired.

As can be seen in FIGS. 1–6, drive car 40 includes two parallel elongated side beams 68 and 70 which are rigidly connected together by cross-beams 72 and 74 and end beams 76 and 78. Cross-beams 72 and 74 each have a roller assembly generally indicated 80 connected therebeneath.

As can be seen in FIGS. 1–6, roller assemblies 80—80 include a top plate 80*a* and a bottom plate 80*b* rigidly connected together by a spacer plate 80*c*. Also connected to top plate 80*a* and bottom plate 80*b* are axles 80*d* and 80*e* which hold rollers 80*f* and 80*g* thereon, respectively. Rollers 80*f* and 80*g* make rolling contact with tracks 54 and 56 to enable drive car 40 to move along tracks 54 and 56 to connect drive car 40 to pipe shuttle 38 and to connect mandrel 41 to pipe 42.

Figure 3:
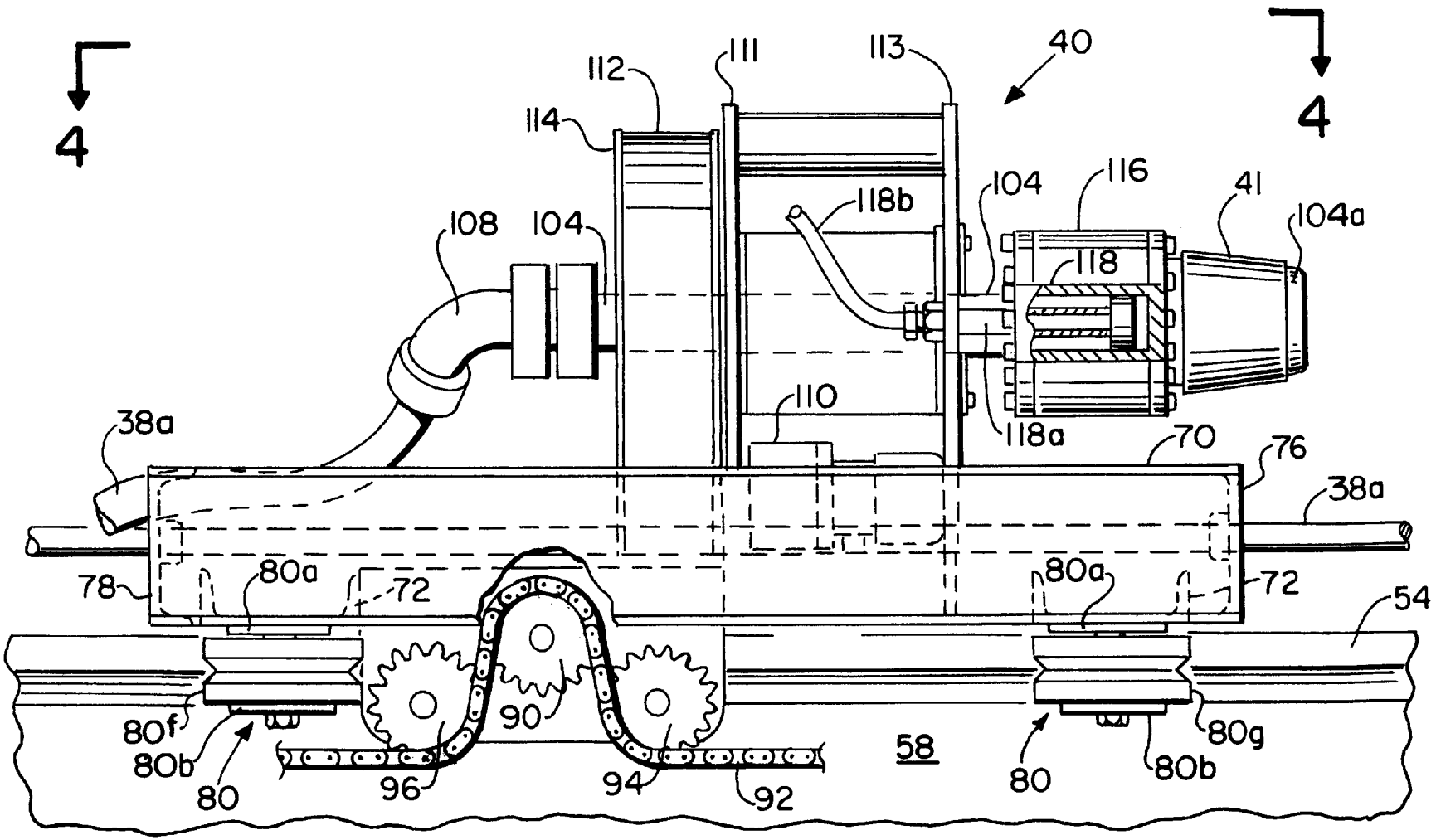
FIG. 3 is a side elevational view, partially cut-away, taken along lines 3—3 of FIG. 1A.
Figure 6:
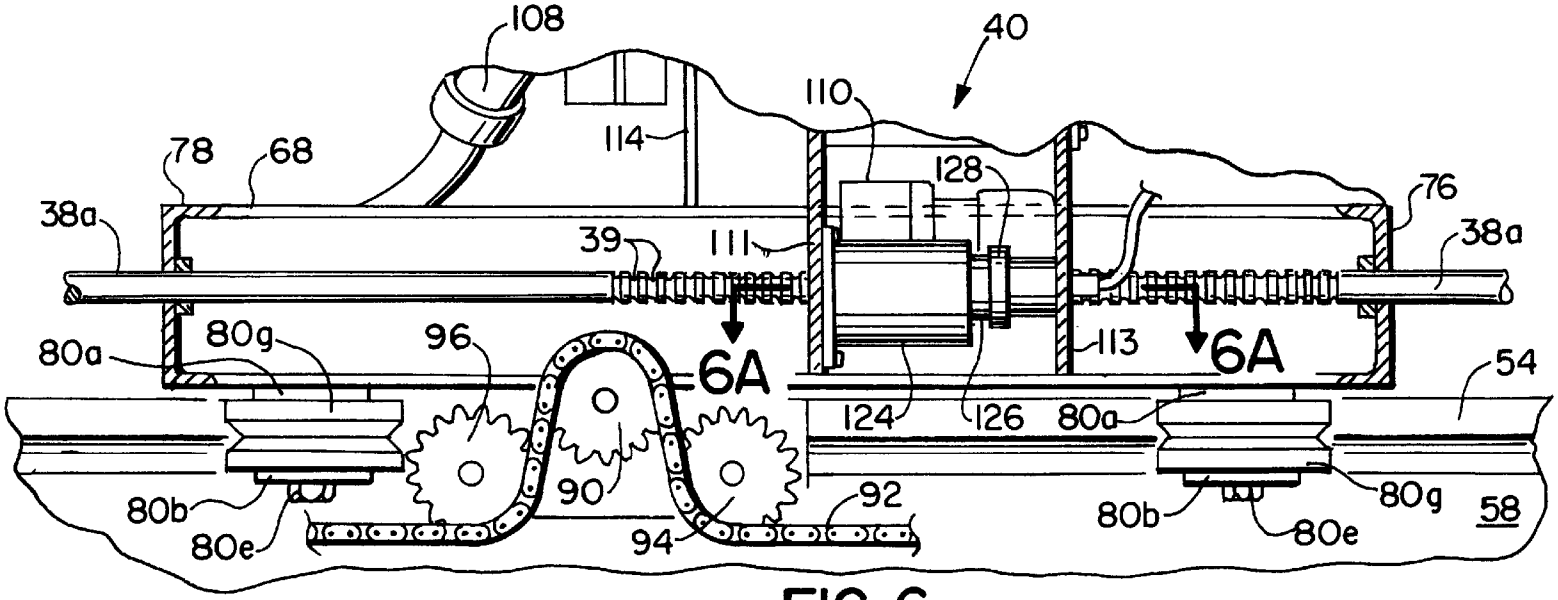
FIG. 6 is a cross-sectional view, partly cut-away, taken along lines 6—6 of FIG. 4.

Drive car 40 is driven forward and backward by drive gear 90 shown in FIGS. 3 and 6, and drive chain 92 shown in FIGS. 1B, 3, 6–11, and 13. The right end 92*a* of drive chain 92 shown in FIG. 19 is rigidly connected to the bottom 65 of tank 66. Drive chain 92 lies loosely on the bottom 65 of tank 66 to the vicinity of idler gear 94. Idler gear 94 feeds chain 92 from bottom 65 upward to drive gear 90. Chain 92 extends around gear 90 and around idler gear 96. From idler gear 96, chain 92 extends downward to bottom 65 to end plate 65*a*, where the left end of the chain is rigidly connected to bottom 65.

Figure 4:
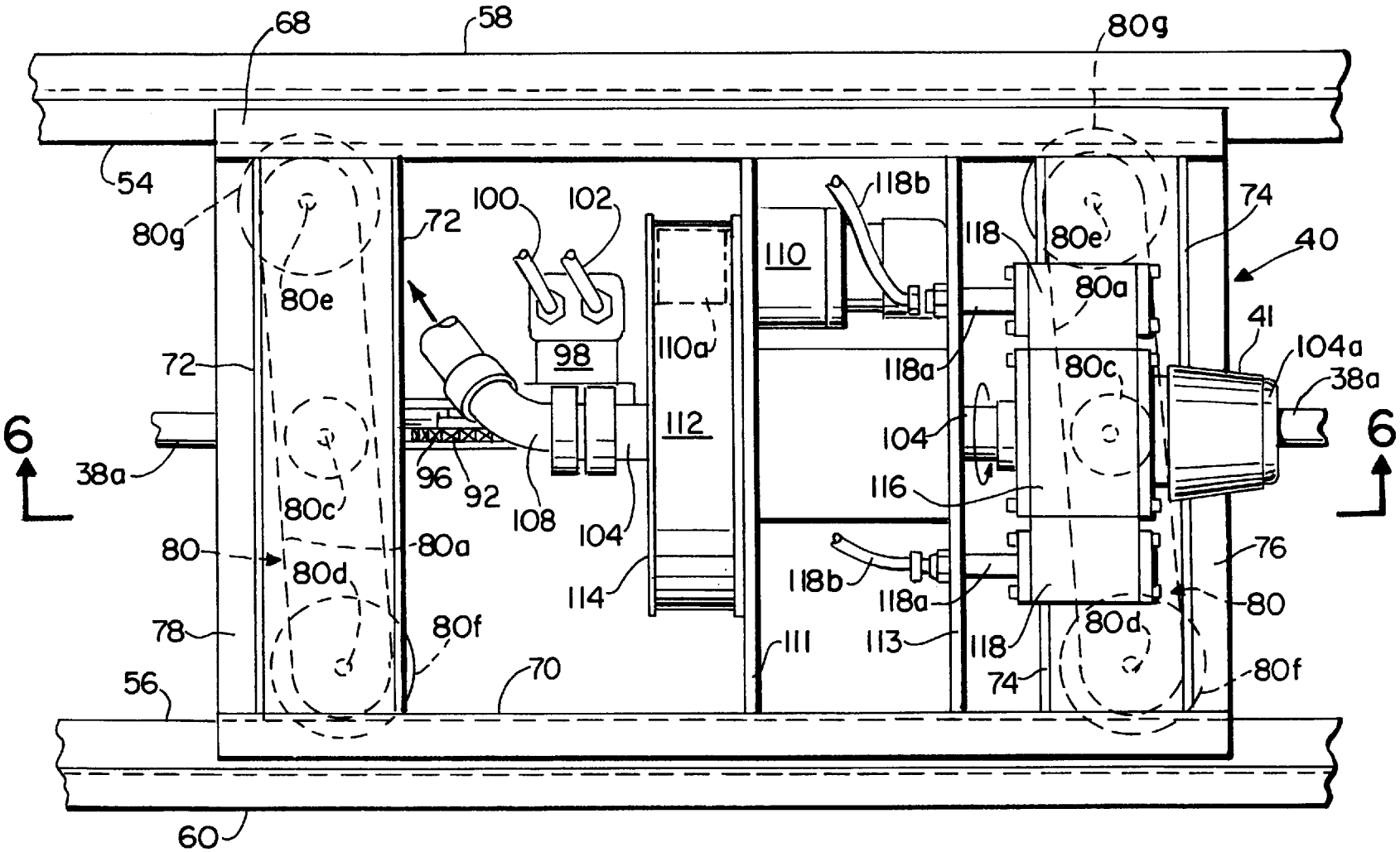
FIG. 4 is a schematic top view, taken along lines 4—4 of FIG. 3, of the apparatus shown in FIG. 3.

Drive gear 90 is driven by hydraulic motor 98 shown in FIG. 4. Hydraulic fluid is supplied to motor 98 through hoses 100 and 102. To propel drive car 40 forward toward pipe shuttle 38 and lance assembly 32, hydraulic fluid under pressure supplied from a remote pump (not shown) enters motor 98 through hose 100 and exits through hose 102 to rotate drive gear 90 counter-clockwise as viewed in FIG. 6. To propel drive car 40 away from lance assembly 32, the direction of hydraulic fluid flow to motor 98 is reversed, and hydraulic fluid enters motor 98 through hose 102 and exits through hose 100 to turn drive gear 90 clockwise.

After placement of pipe 42 on pipe shuttle 38 as shown in FIGS. 1A and FIG. 5, hydraulic fluid is supplied to motor 98 to propel drive car 40 forward in the direction indicated by the arrow in FIG. 5 forcing mandrel 41 into the internally threaded end 42*a* of pipe 42. Mandrel 41 is mounted on a cylindrical drive shaft 104 having an enlarged outer end cap 104*a* and a central bore (not shown). Water introduced inside of pipe 42 through internal scraper 33*b* travels through the central bore in drive shaft 104 to outlet conduit 108 into tank 66 and out of the externally threaded end of pipe 42 into which internal scraper 33*b* in inserted into tank 66.

As shown in FIG. 4, electric motor 110 turns sheave 110*a*. Electric motor 110 is rigidly connected to parallel plates 111 and 113, which are rigidly connected to beams 68 and 70. Sheave 110*a* drives belt 112 which turns sheave 114 connected to drive shaft 104, thereby rotating drive shaft 104, mandrel 41, and pipe 42.

As shown in FIGS. 3–5A, a mandrel compression housing 116 surrounds drive shaft 104 without contacting drive shaft 104. Mandrel compression housing 116 is rigidly connected to two hydraulic cylinders 118—118. Hydraulic cylinders 118 are rigidly connected by hollow cylinders 118*a*—118*a* to plate 113. Hoses 118*b*—118*b* are connected to hollow pistons 118*a*—118*a* to supply hydraulic fluid under pressure to hollow pistons 118*a*—118*a*. Each of the hydraulic cylinders 118—118 have a hollow piston 118*a* therein which slides inside bore 118*d*—118*d* of hydraulic cylinders 118 as shown in FIG. 5.

To expand elastic mandrel 41 to the position shown in FIG. 5A and lock mandrel 41 securely to pipe 42, hydraulic fluid under pressure is introduced through hoses 118*b*—118*b*. From hoses 118*b*—118*b*, hydraulic fluid under pressure flows through hollow pistons 118*a*—118*a* as indicated by the arrows in FIG. 5A, thereby forcing hydraulic cylinders 118—118 and mandrel compression housing 116 forward to compress elastic mandrel 41 against end cap 104*a* and expand mandrel 41 diametrically outward into contact with the inside of the internally threaded end of pipe 42.

Figure 6B:
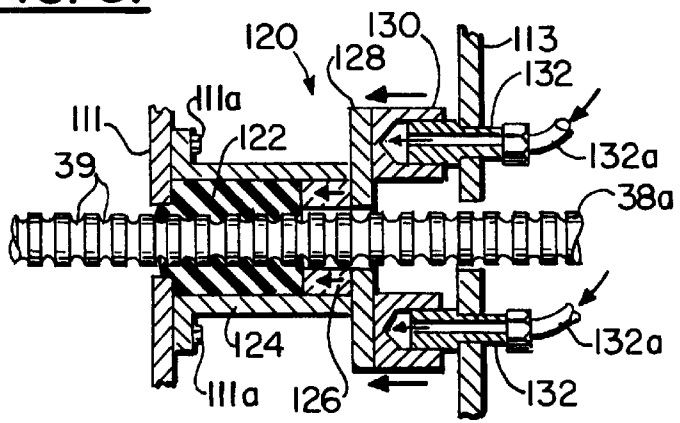
FIG. 6B shows the compressible bushing of FIG. 6A in the compressed position.
Figure 6A:
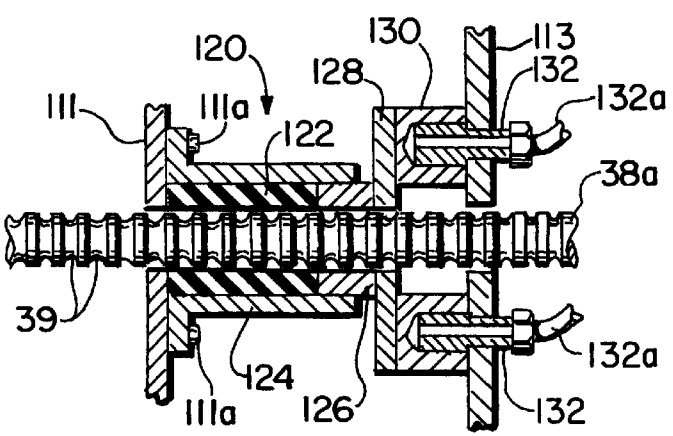
FIG. 6A is a partly cross-sectional view taken along lines 6A—6A of FIG. 6 enlarge to show the compressible bushing therein.
Figure 7:
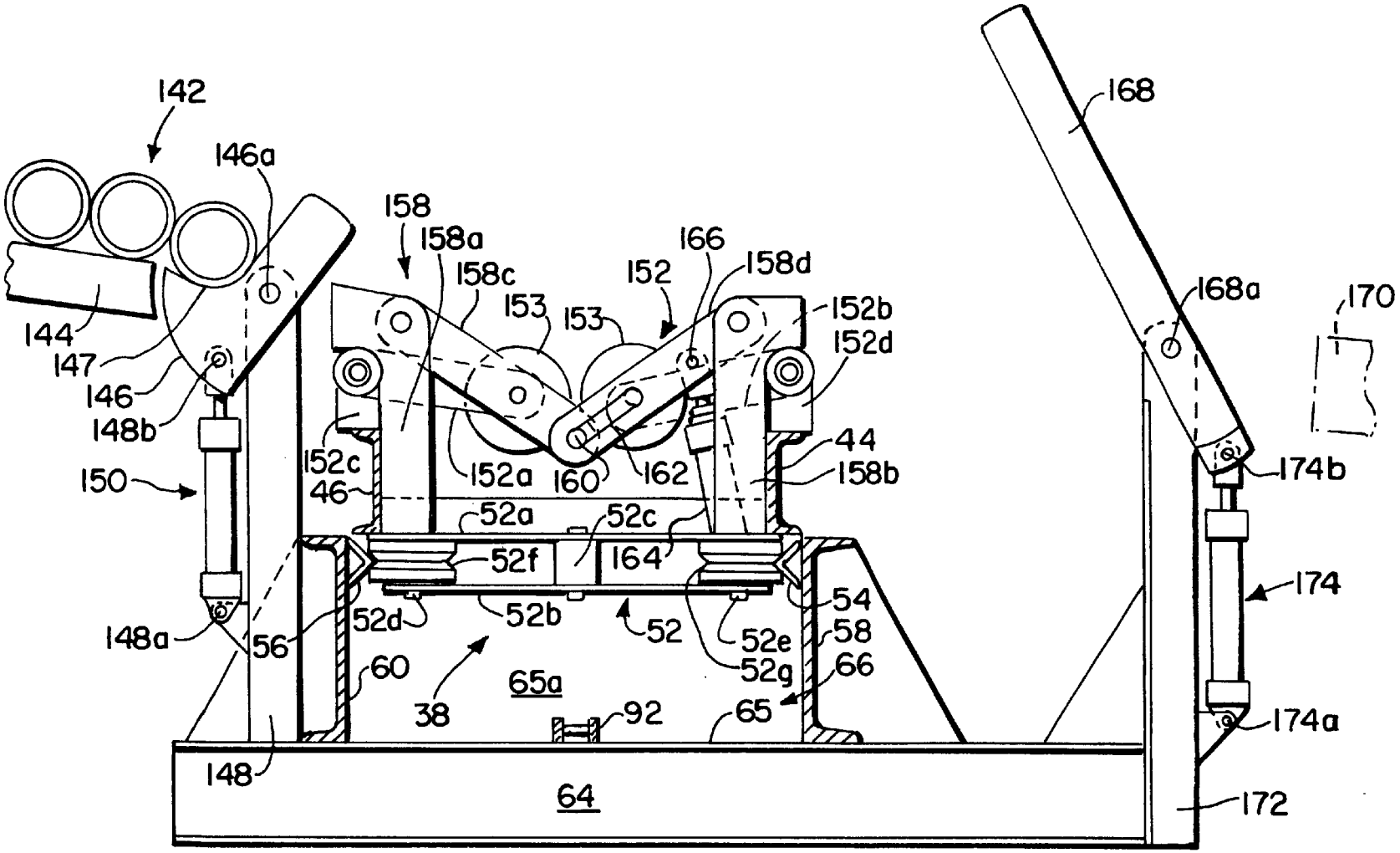
FIG. 7 is a schematic, partly cross-sectional view of the pipe shuttle of the invention prior to having a pipe placed thereon.

Connecting rod 38*a* is selectively secured to drive car 40 by the connecting rod locking assembly generally indicated by the numeral 120 shown in FIGS. 6, 6A, and 6B. Connecting rod locking assembly 120 utilizes a cylindrical compressible bushing 122 contained in a hollow cylindrical housing 124. Compressible bushing 122 has a cylindrical bore therein for receipt of connecting rod 38*a*. Housing 124 is rigidly connected to plate 111 by screws 111*a*.

A ram 126 is received in hollow cylindrical housing 124 as shown in FIGS. 6A and 6B. Ram 126 rests against the end of compressible bushing 122. Ram 126 has a central bore for receipt of connecting rod 38*a*. Ram 126 is rigidly connected to ram plate 128. Ram plate 128 has two hollow cylinders 130—130 rigidly connected thereto. Hollow cylinders 130—130 each have a hollow cylindrical stationary piston 132 slidably received therein. Pistons 132—132 are rigidly connected to plate 113 as shown in FIGS. 6A and 6B. Each of the pistons 132—132 have a hose 132*a*—132*a* connected thereto for selectively supplying hydraulic fluid to each of the pistons 132—132.

As shown by the arrows in FIG. 6B, when hydraulic fluid is directed to hoses 132*a*—132*a*, hydraulic fluid enters the interior of hollow cylinders 130—130 and forces cylinders 130—130 and ram plate 128 in the direction indicated by the arrows to compress compressible bushing 122 into grooves 39 in connecting rod 38*a*. When compressible bushing 122 is compressed as shown in FIG. 6B, connecting rod 38*a* is securely fastened to drive car 40, thus securing pipe shuttle 38 to drive car 40. When compressible bushing 122 is not compressed as shown in FIG. 6A, drive car 40 may be moved away from pipe shuttle 38 as shown in FIG. 1A and FIG. 5. Preferably, compressible bushing 122 is secured to connecting rod 38*a* after mandrel 41 is inserted into the internally threaded end 42*a* of pipe 42 and before mandrel 41 is compressed to the position shown in FIG. 5A.

Pipes to be cleaned which are placed on storage rails 144—144 are generally indicated by the numeral 142 in FIGS. 1A and 7–9. Storage rails 144—144 are inclined at an acute angle with the ground to bias pipes 142 by gravity toward a plurality of transfer arms 146. Transfer arms 146 have a concave portion 147 which receives and holds pipe 42. Transfer arms 146 pivot on pin 146*a* connected to vertical transfer arm support beams 148. Vertical support beams 148 are rigidly connected to the side of beam 60. A hydraulic or pneumatic piston assembly generally indicated by the numeral 150 is connected to the outside of each support beam 148 and to transfer arm 146 to rotate transfer arms 146 from the position shown in FIG. 7 to the position shown in FIG. 8. Piston assembly 150 is connected to support beam 148 by pin 148*a* and to transfer arm 146 by pin 148*b*. As shown by the arrows in FIG. 8, a pipe 42 is loaded onto pipe shuttle 38 when pipe transfer arms 146—146 are rotated from the position shown in FIG. 7 by piston assemblies 150 to the position shown in FIG. 8.

Pipe 42 is received and rotatably held on pipe shuttle 38 by the pipe roller assemblies generally indicated by the numeral 152 in FIGS. 1A, 2A, and 7–11. Each pipe roller assembly includes a first arm 152*a* and a second arm 152*b* rigidly connected to block 152*c* and 152*d*, respectively. Blocks 152*c*—152*c* are rigidly connected to the top of beam 46 and blocks 152*d*—152*d* are rigidly connected to the top of beam 44. A roller 153 is rotatably connected to each arm 152*a* and 152*b* by axle 153*a*. Rollers 153—153 rotatably hold pipe 42 before mandrel 41 is connected to pipe 42 and after mandrel 41 is connected to pipe 42 and is rotating pipe 42.

As shown in FIGS. 1A, 2A, and 7–11, pipe 42 is removed from pipe shuttle 38 by the pipe removal assembly generally indicated by the numeral 158. Each pipe removal assembly 158 has two vertical support members 158*a* and 158*b* rigidly connected to the inside of beam 46 and beam 44 respectively. Rotatably connected to each vertical support member 158*a* is first removal arm 158*c*, and rotatably connected to each vertical support member 158*b* is second removal arm 158*d*. First removal arm 158*c* has a pin 160 rigidly connected thereto. Second removal arm 158*d* has an elongated slot 162 therein which slidably receives pin 160 therein.

Figure 8:
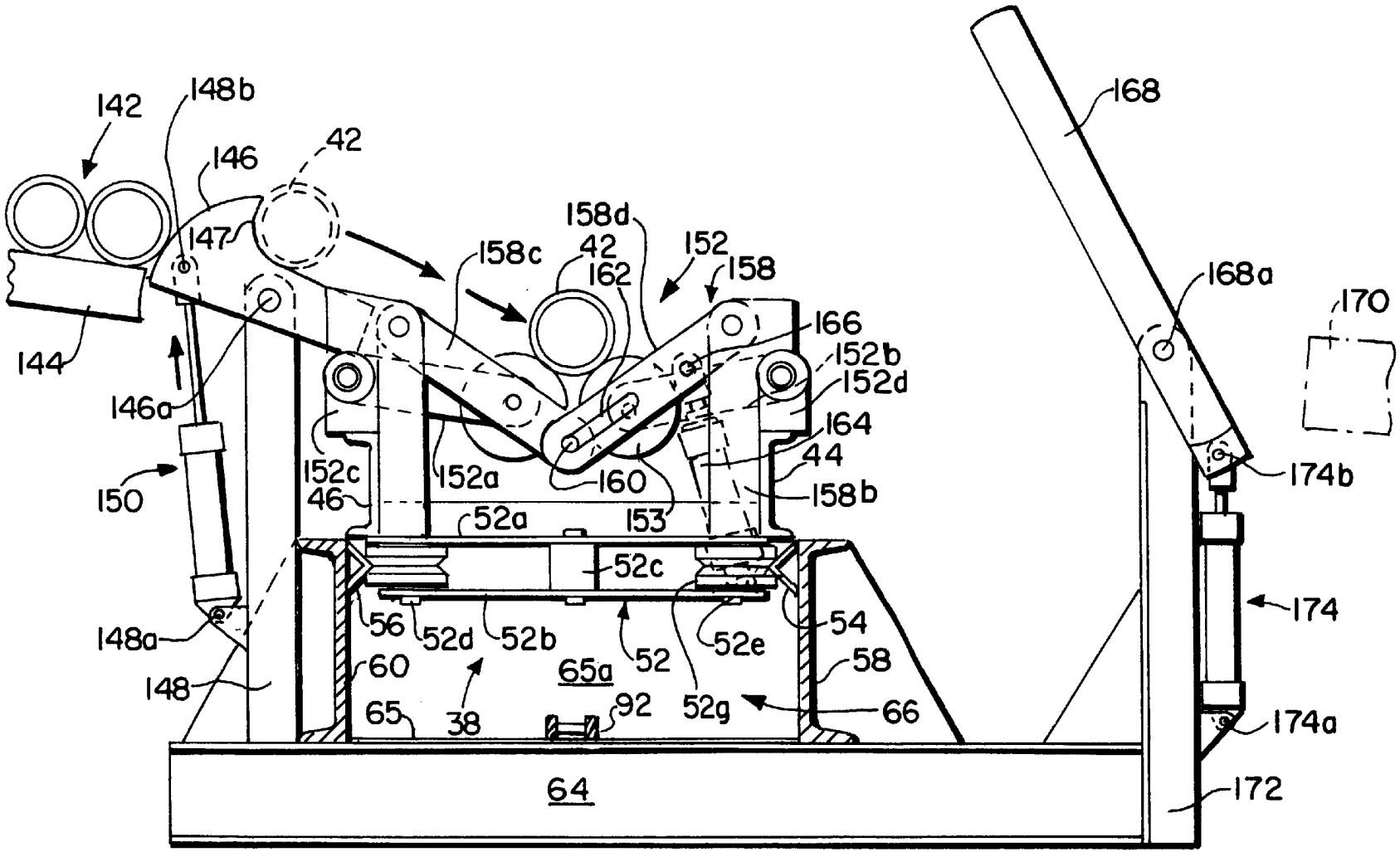
FIG. 8 is a schematic, partly cross-sectional view of the pipe shuttle of the invention showing a pipe being placed thereon.
Figure 9:
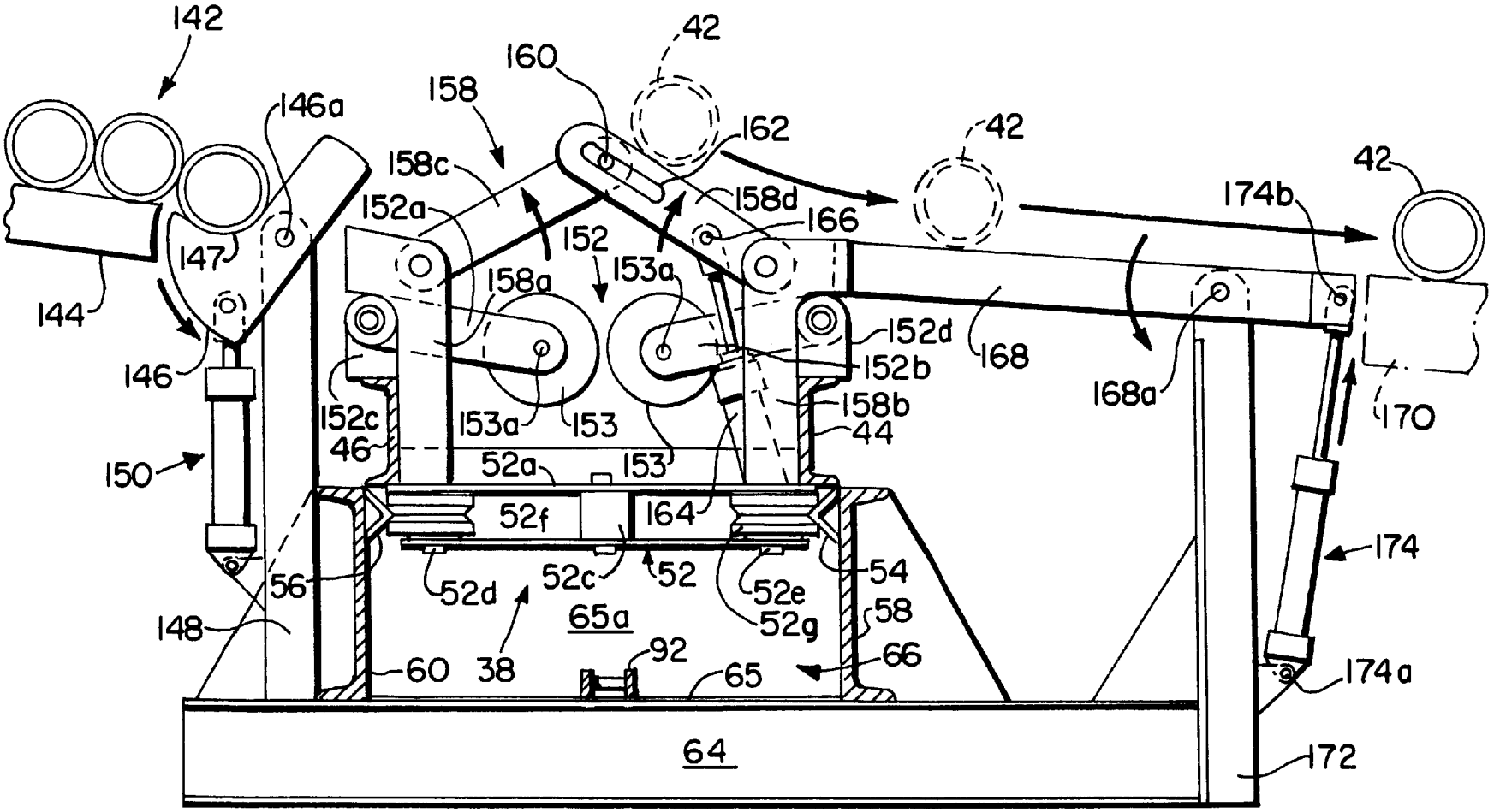
FIG. 9 is a schematic, partly cross-sectional view of the pipe shuttle of the invention showing a pipe being ejected therefrom and placed on a storage rack.

A hydraulic or pneumatic piston assembly generally indicated by the numeral 164 is connected to each removal arm 158*d* to rotate removal arms 158*c* and 158*d* from the position shown in FIG. 8 to the position shown in FIG. 9. Piston assembly 164 is connected to beam 44 and to removal arm 158*d* by pin 166. As shown by the arrows in FIG. 9, a pipe 42 is removed from pipe shuttle 38 when pipe removal arms 158*c* and 158*d* are rotated from the position shown in FIG. 8 by piston assemblies 164 to the position shown in FIG. 9. As pipe 42 is removed from pipe shuttle 38, a plurality of conveyer arms 168 are lowered from the position shown in FIG. 8 to the position shown in FIG. 9 to enable pipe 42 to roll onto clean pipe storage rails 170—170.

Conveyer arms 168—168 pivot on pin 168*a* connected to vertical conveyer arm support beams 172. Each support beam 172 is rigidly connected to the side of beam 64. A hydraulic or pneumatic piston assembly generally indicated by the numeral 174 is connected to each support beam 172 and conveyer arm 168 to rotate conveyer arms 168 from the position shown in FIG. 8 to the position shown in FIG. 9. Piston assembly 174 is connected to beam 172 by pin 174*a* and to conveyer arm 168 by pin 174*b*.

Pipes that have been cleaned and stored are generally indicated by the numeral 242 in FIG. 1A. Pipes 242 are stored on storage rails 170—170 which are inclined at an acute angle with the ground to bias pipes 242 by gravity toward the end of rails 170—170.

Figure 11:
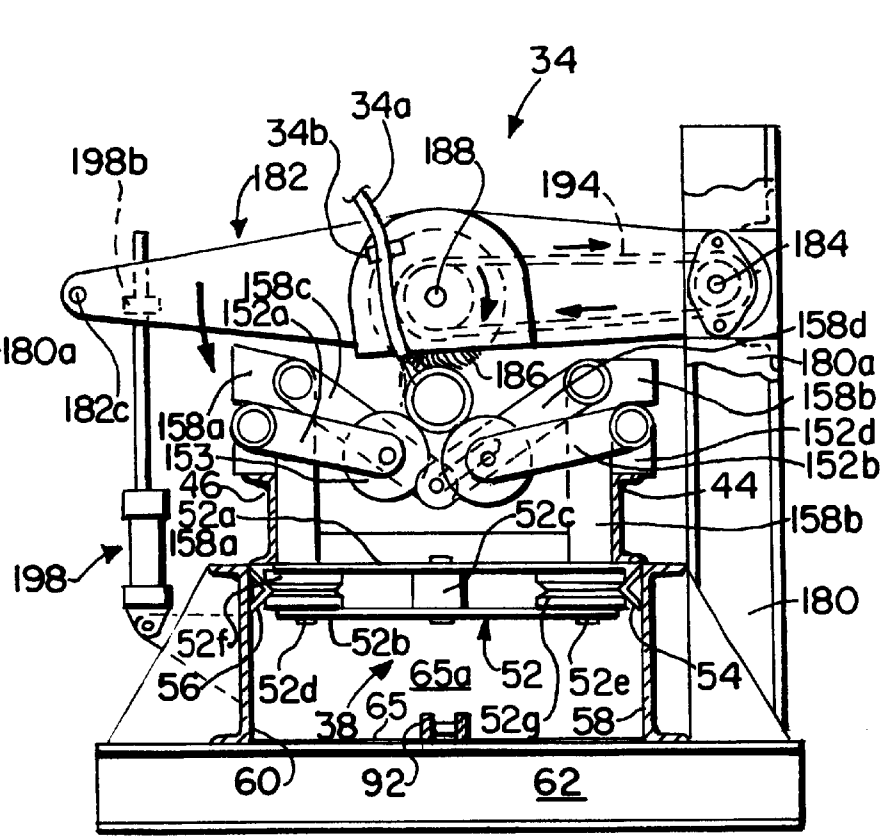
FIG. 11 is a schematic, elevational view of the wire brush assembly cleaning a rotating pipe.
Figure 10:
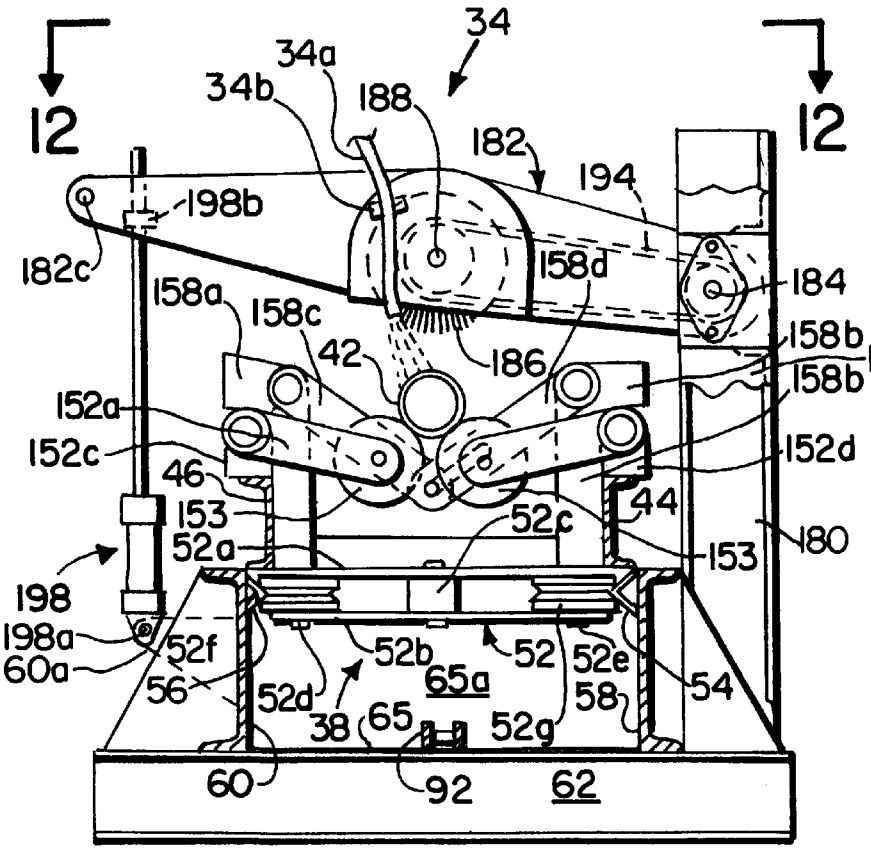
FIG. 10 is a schematic, elevational view of the wire brush assembly of the invention.
Figure 12:
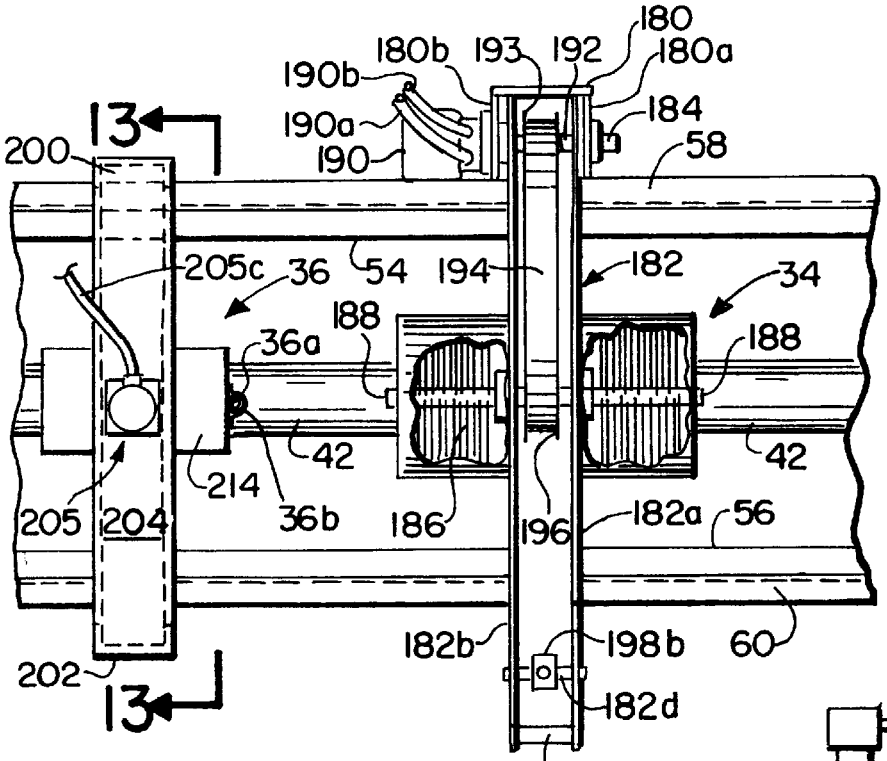
FIG. 12 is a top view of the apparatus shown in FIG. 10 taken along lines 12—12 of FIG. 10 showing the external scraper assembly and the wire brush assembly of the invention.

Wire brush assembly 34 is shown in detail in FIGS. 10, 11, and 12. Wire brush assembly 34 is supported by vertical support beam 180 which is rigidly connected to the outside of beam 58. Wire brush assembly 34 has a brush arm generally indicated by the numeral 182 which pivots about pin 184. Brush arm 182 has two parallel plates 182*a* and 182*b* which are rigidly connected together by spacer 182*c* and pin 182*d*. Pin 184 is rotatably connected to support beam 180. A wire brush 186 is rotatably connected to arm 182 by axle 188. Axle 188 is rotatably connected to parallel plates 182*a* and 182*b*.

Support beam 180 has two flat plates 180*a* and 180*b* rigidly connected thereto. A hydraulic motor 190 having drive shaft 192 is rigidly connected to plate 180*b* as shown in FIG. 12. Hydraulic fluid under pressure enters motor 190 through hose 190*a* and exits motor 190 through hose 190*b*. Drive shaft 192 has a sheave 193 rigidly connected thereto which receives drive belt 194. Drive belt 194 extends from sheave 193 to sheave 196. Sheave 196 is rigidly connected to axle 188 to rotate axle 188 and wire brush 186 to clean the outer surface of pipe 42.

A hydraulic or pneumatic piston assembly generally indicated by the numeral 198 is connected to beam 60 and brush arm 182 to rotate brush arm 182 from the position shown in FIG. 10 to the position shown in FIG. 11 to place rotating brush 186 into contact with the outer surface of pipe 42 to clean pipe 42. Piston assembly 198 is connected to beam 60 by bracket 60*a* and pin 198*a*, and to brush arm 182 by bracket 198*b*.

External scraper assembly 36 is shown in detail in FIGS. 12–17. External scraper assembly 36 is supported by two vertical parallel support beams 200 and 202 which are rigidly connected at their lower ends to the outside of beams 58 and 60, respectively. Support beams 200 and 202 are rigidly connected together at their upper ends by cross-beam 204. Cylinder 205*a* of the pneumatic piston assembly generally indicated by the numeral 205 is rigidly connected to cross-beam 204. Air enters and exits cylinder 205*a* through hoses 205*c*—205*c*.

Located beneath cross-beam 204 is a vertically movable scraper support frame generally indicated by the numeral 206. Movable rod 205*b* of piston assembly 205 is connected to movable frame 206 to move movable frame 206 upward and downward as indicated by the arrow in FIG. 13 to force scrapers 208 and 210 into contact with the outer surface of pipe 42 to clean pipe 42.

Movable frame 206 travels in the U-shaped channel 200*a* and 202*a* on the inner sides of beams 200 and 202 as indicated by the phantom lines in FIG. 12. Movable frame 206 has an upper horizontal member 206*a* and a lower horizontal member 206*b*. Vertical end members 206*c* and 206*d* indicated by phantom lines in FIG. 12 are rigidly connected to upper horizontal member 206*a* to lower horizontal member 206*b* and are slidably located in U-shaped channel 200*a* and 202*a*, respectively.

Figure 14:
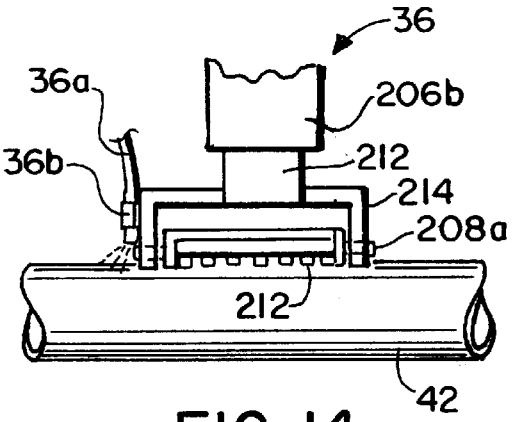
FIG. 14 is an elevational view of the apparatus shown in FIG. 13 taken along lines 14—14 of FIG. 13.
Figure 13:
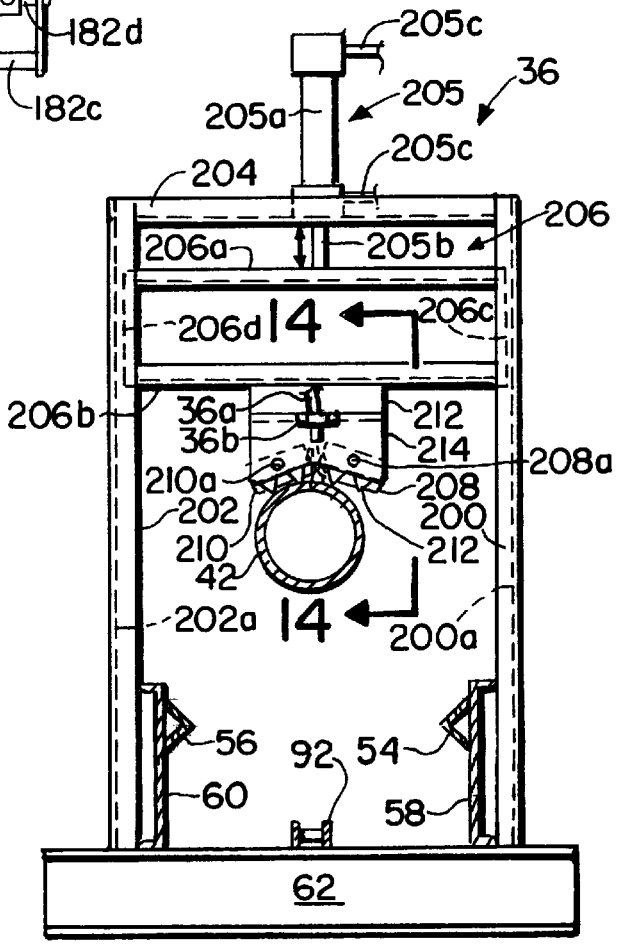
FIG. 13 is a partly cross-sectional, partly cut-away elevational view of the apparatus shown in FIG. 12 taken along lines 13—13 of FIG. 12 showing the external scraper of the invention.
Figure 15:
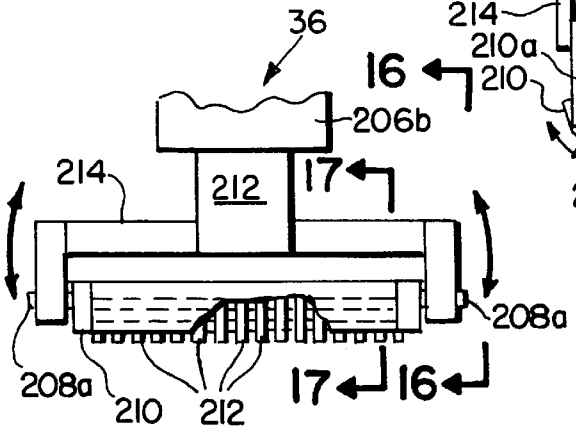
FIG. 15 is a schematic elevational view, partly cut-away, of the external scraper assembly of the present invention.

As can be seen in detail in FIGS. 14 and 15, block 212 is rigidly connected to lower horizontal member 206*b* and to U-shaped scraper bracket 214. Scrapers 208 and 210 are pivotally connected to U-shaped scraper bracket 214 by shafts 208*a* and 210*a* to enable the scrapers 208 and 210 to pivot as shown by the arrows in FIG. 16 when large corrosion deposits and scale are encountered on the surface of pipe 42.

Figure 17:
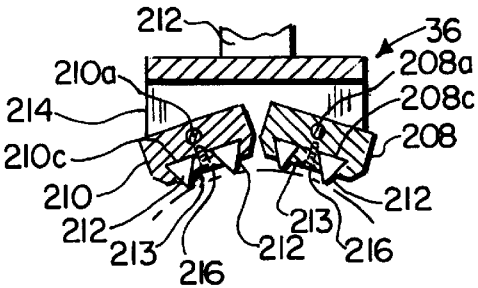
FIG. 17 is a of the apparatus shown in FIG. 15 taken along lines 17—17 of FIG. 15.
Figure 18:
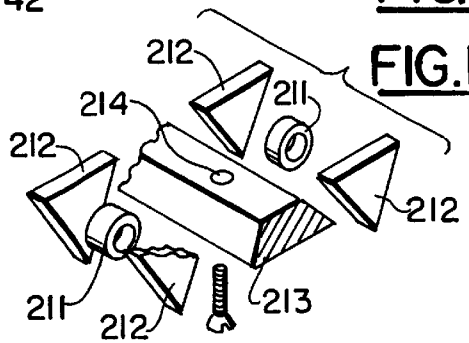
FIG. 18 is an exploded, enlarged schematic view of the cutting teeth assembly of the external scraper of the present invention.
Figure 16:
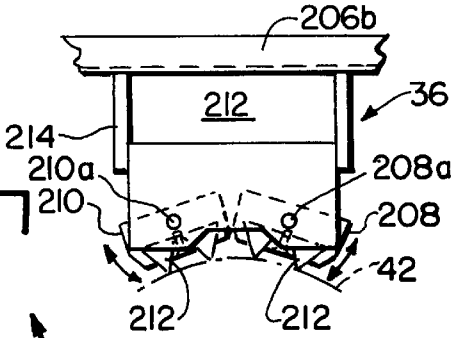
FIG. 16 is a view of the apparatus shown in FIG. 15 taken along lines 16—16 of FIG. 15.

Scrapers 208 and 210 have a plurality of teeth 212 connected thereto which contact the surface of pipe 42 to machine heavy scale and corrosion deposits therefrom. Scrapers 208 and 210 function as carriers for cutting teeth 212. Teeth 212 are preferably made from hard metal alloys such as tungsten-carbide alloys and the like. Teeth 212 are held in place in scrapers 208 and 210 by two identical wedges 213—213 shown in detail in FIG. 18. Teeth 212 are triangular in shape and are received in slots 208*c* and 210*c* in scrapers 208 and 210 as shown in FIG. 17. Spacers 211 separate teeth 212. Wedges 213—213 have a plurality of cylindrical holes 214 therein for receipt of screws 216 which fasten wedges 213—213 to scrapers 208 and 210. The wedges hold teeth securely to scrapers 208 and 210.

As can be seen in detail in FIGS. 20–26, internal scraper 33*b* preferably has four movable blade assemblies 220 and four movable blade assemblies 222 movably connected to the hollow cylindrical blade housing 224. The number of blade assemblies may be varied if desired. The blade assemblies 220 and 222 are preferably grouped in opposing pairs rotated 90 degrees apart along the length of blade housing 224. Blade assemblies 220 and 222 are snugly received in opposing cavities 220*a* and 222*a* formed in hollow cylindrical housing 224. Cavities 220*a* and 222*a* extend radially outward from the central axis of cylindrical housing 224 to the outer surface of cylindrical housing 224 and are rectangular in cross-section. Blade assemblies 220 and 222 have a blade carrier 220*b* and 222*b*, respectively, slidably received therein. The clearance or tolerance for the sliding fit of blade carriers 220*b* and 222*b* are selected so that water under pressure in central bore 232 of cylindrical housing 224 will force blade carriers 220*b* and 222*b* outward with sufficient force to cut and scrape rust, corrosion and scale from the interior of pipe 42. Blade carriers 220*b* and 222*b* are prevented from falling out of cavities 220*a* and 222*a*, respectively, by removable pins 226.

Figures 20, 21, 22, 23, 24, 25, 26:
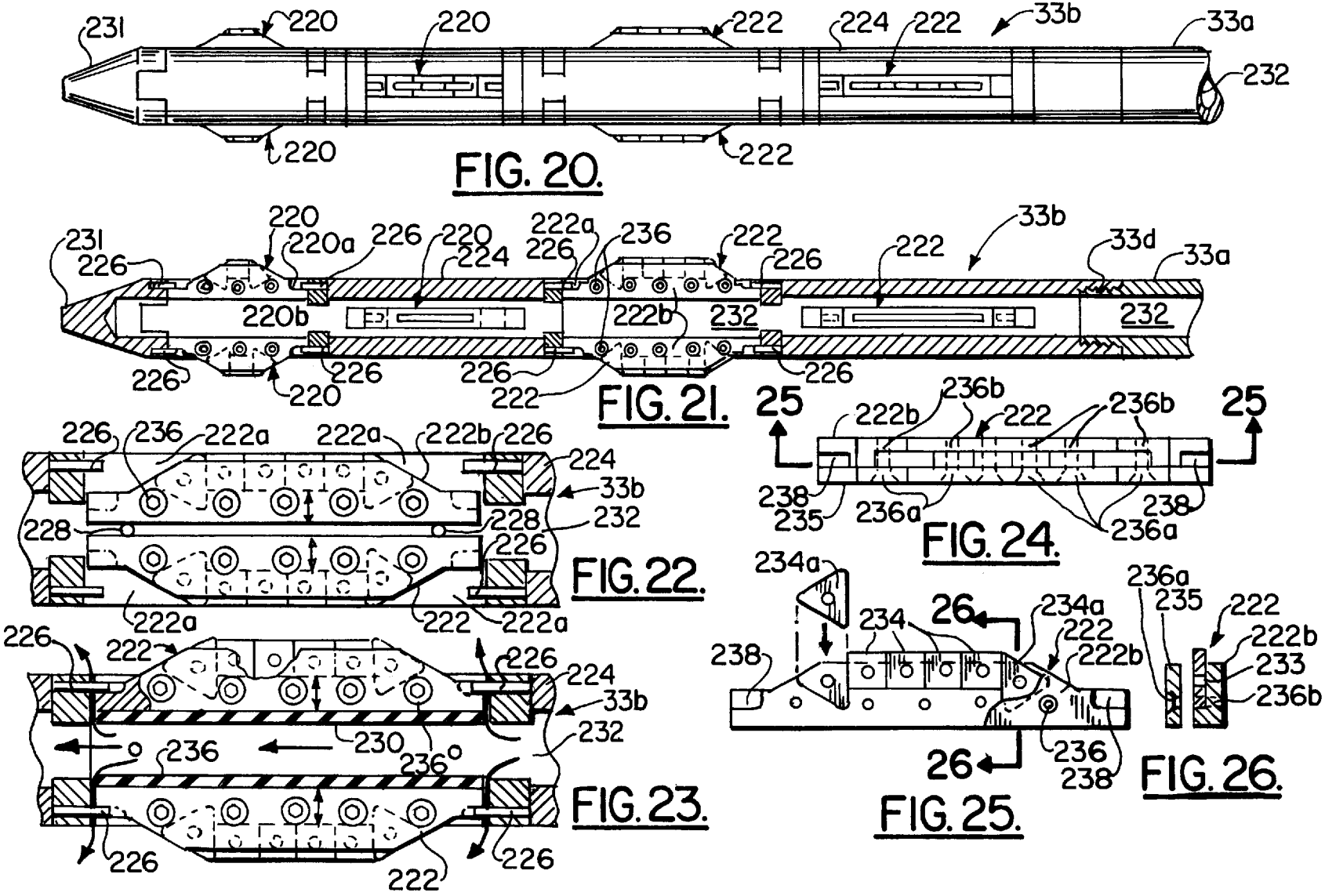
FIG. 20 is a schematic, partly cut-away, side view of the internal scraper of the invention showing a plurality of scraper blade assemblies therein.
FIG. 21 is a partly cut-away, partly cross-sectional view of the internal scraper of FIG. 20.
FIG. 22 is a partly cut-away, partly cross-sectional enlarged view of a portion of the internal scraper of FIGS. 20 and 21.
FIG. 23 is a schematic, partly cut-away, partly cross-sectional view of an alternate embodiment of the apparatus shown in FIG. 22 after water under pressure flows therethrough as indicated by the arrows therein.
FIG. 24 is a top view of the one of the plurality of scraper blade assemblies of the internal scraper of FIGS. 20 and 21.
FIG. 25 is an elevational view of the apparatus shown in FIG. 24 taken along lines 25—25 of FIG. 24.
FIG. 26 is an elevational view of the apparatus of FIG. 25 taken along lines 26—26 of FIG. 25.

As shown in FIG. 22, two pins 228 may be placed in cylindrical housing 224 to keep opposing blade carriers from touching; if desired, pins 228 may be omitted as shown in FIG. 21. In the embodiment shown in FIG. 23, a cylindrical insert 230 may be located between the blade carriers outward against pins 226 reduce the rate of water flow from the inside bore 232 of cylindrical housing 224 outwardly between the blade carriers 220*b* and 222*b* and the walls of cavities 220*a* and 222*a* as indicated by the arrow in FIG. 23. Preferably, insert 230 is a polymeric or plastic material.

Preferably water is supplied to bore 232 under a pressure about 50 pounds per square inch to force blade carriers 220*b* and 222*b* to slide outward in cavities 220*a* and 222*a* from the outer surface of cylindrical housing 224 with sufficient force for blades 234 and 234*a* to contact, and cut and remove, corrosion, rust and scale from the inside of a pipe such as pipe 42. A tapered end cap 231 is rigidly connected to the outer end of internal scraper 33*b* to prevent water from escaping therefrom and to aid in the insertion of lance 33 into the interior of pipe 42.

The outside diameter of internal scraper 33*b* is selected to insure that the inside diameter of the pipe being cleaned meets any required standards of the industry in which the pipe is being used. The oil and gas industry require that pipe used in drilling and production operations has certain minimum inside diameter, or "drift", to enable standard sized tools can be dropped into the pipe and travel completely therethrough. Cleaning the entire pipe 42 with an internal scraper 33*b* having the required minimum outside diameter insures that the clean pipe meets the industry standard.

A typical blade assembly 222 is shown in FIGS. 24–26. Blade assembly 220 is identical to blade assembly 220 except for having fewer blades 234. Rectangular shaped blades 234 and triangular shaped blades 234*a* are held in a slot or groove 233 formed in blade carrier 222*b*. Blades 234 and 234*a* are preferably made from hard metal alloys such as tungsten-carbide alloys and the like. As can be seen in FIG. 26, blades 234 and 234*a* are held in groove 233 by blade holding plate 235 which is secured to blade carrier 222*b* by a plurality of screws 236 which are received in screw holes 236*a* in plate 235 and threaded screw holes 236*b* in blade carrier 222*b*. Preferably, blade carrier 222*b* has a slot 238 shown in FIGS. 24 and 25 at each end thereof for receipt of pin 226 when blade carrier 222*b* is in the position shown in FIGS. 21 and 23.

As shown in FIGS. 1B, 2B, and 19, lance 33 is supported by the lance support car generally indicated by the numeral 250. Lance support car 250 has two rectangular side walls 252 and 254 rigidly connected to two end walls 256 and 258. Rollers 260—260 are connected to the bottom of rectangular side walls 252 and 254 similar to rollers 52*f* and 52*g* of pipe shuffle 38 and engage tracks 54 and 56. Rollers 260—260 enable lance support car 250 to move along tracks 54 and 56.

Extending upward from car 250 is lance support arm 262. Lance support arm 262 has a roller 262*a* at the upper end thereof which engages the bottom of lance 33 to hold lance 33 in alignment with pipe 42 for insertion therein. Lance support arm 262 is pivotally connected at its bottom end to beam 264 which is rigidly connected to end walls 256 and 258. Lance support arm 262 is biased upward by spring 266 which is connected to lance support arm 262 and end wall 256.

As shown in FIG. 19, lance support car 250 is moved to the right as indicated by the arrow by pipe shuffle beam 268 which is rigidly connected to pipe shuffle 38. Lance support car 250 is connected to pipe shuffle beam 268 by chain 270 shown in FIGS. 2B and 19. The length of chain 270 is selected so that lance support car 250 stops beneath lance 33 near the end of lance 33 when pipe shuttle 38 is fully retracted to the position shown in FIGS. 1A, 1B, and 2B to align lance 33 for insertion into the interior of pipe 42.

Although the preferred embodiments of the invention have been described in detail above, it should be understood that the invention is in no sense limited thereby, and its scope is to be determined by that of the following claims:

What is claimed is:

1. An apparatus for cleaning the interior and exterior of a corroded pipe comprising:

a. a pipe shuttle for rotatably holding a pipe being cleaned, b. a stationary lance assembly for insertion into the interior of said pipe to scrape and clean the interior of said pipe, c. an external scraper for scraping the outer surface of said pipe, d. a wire brush assembly for cleaning the outer surface of said pipe, and e. a drive car for rotating said pipe and driving said rotating pipe onto said lance assembly and into contact with said external scraper and said wire brush assembly.

2. The apparatus of claim 1 wherein said lance assembly comprises a stationary pipe connected to a cylindrical internal scraper having a central bore therein.

3. The apparatus of claim 2 wherein said internal scraper has a plurality of cutting blades therein which slide outward from the interior of said cylindrical internal scraper when water under pressure is supplied to said central bore of said internal scraper.

4. The apparatus of claim 3 wherein a water supply is connected to said stationary pipe for providing water under pressure to said stationary pipe and said central bore of said internal scraper to force said cutting blades outward from the interior of said internal scraper.

5. The apparatus of claim 4 wherein said cutting blades are held in cavities in said internal scraper.

6. The apparatus of claim 5 wherein said cavities extend radially outward from the central axis of said cylindrical internal scraper.

7. The apparatus of claim 4 wherein said external scraper has a plurality of metal cutting teeth aligned in two row parallel rows.

8. The apparatus of claim 7 wherein said two parallel rows of cutting teeth are connected to a single carrier.

9. The apparatus of claim 8 wherein said carrier is connected to a movable frame for selectively moving said cutting teeth into contact with the surface of said pipe.

10. The apparatus of claim 7 wherein said drive car has a rotatable mandrel connected thereto for insertion into said pipe to rotate said pipe.

11. The apparatus of claim 10 wherein said mandrel is an elastic bushing connected to a cylindrical expander for expanding said bushing into contact with the inside of said pipe.

12. The apparatus of claim 11 wherein a motor is connected to said drive car and said cylindrical expander for rotating said expander and said bushing.

13. The apparatus of claim 10 wherein said drive car has connecting rod means for connecting said drive car to said pipe shuttle.

14. The apparatus of claim 13 wherein said drive car has a motor for driving said drive car and said pipe shuttle to and from said lance assembly.

15. The apparatus of claim 14 wherein said drive car, said pipe shuttle, and said lance assembly have a tank therebeneath for receiving water dripping therefrom.

16. The apparatus of claim 15 wherein said apparatus has a hose for directing water on the surface of said pipe.

17. The apparatus of claim 15 wherein said pipe shuttle has rollers thereon for rotatably holding said pipe and pipe removal arms for removing said pipe after cleaning.

* * * * *